US005353408A

United States Patent [19]

Kato et al.

[11] Patent Number: 5,353,408

[45] Date of Patent: Oct. 4, 1994

[54] NOISE SUPPRESSOR

[75] Inventors: Yasuhiko Kato; Masao Watari; Makoto Akabane, all of Kanagawa, Japan

[73] Assignee: Sony Corporation, Japan

[21] Appl. No.: 998,724

[22] Filed: Dec. 30, 1992

[30] Foreign Application Priority Data

Jan. 7, 1992 [JP] Japan ..... 4-018478

[51] Int. Cl.[5] ..... G10L 9/14

[52] U.S. Cl. ..... 395/2.35; 381/46; 395/2.71

[58] Field of Search ..... 381/46, 47; 395/2.35, 395/2.71

[56] References Cited

U.S. PATENT DOCUMENTS 4,696,039 9/1987 Doddington ..... 381/46
4,811,404 3/1989 Vilmur et al. ..... 381/94
5,012,519 4/1991 Adlersberg et al. ..... 381/47
5,168,524 12/1992 Kroecher et al. ..... 381/43

FOREIGN PATENT DOCUMENTS 2-179700 7/1990 Japan .

*Primary Examiner*—Allen R. MacDonald
*Assistant Examiner*—Richard J. Kim
*Attorney, Agent, or Firm*—Ronald P. Kananen

[57] ABSTRACT

A code conversion table, in which a code of a voice with noise added thereto and a code of a voice without noise are associated with each other in terms of probability, is referred to in a code converter. Using the code converter, a code is obtained in a vector quantizer by vector-quantizing cepstrum coefficients extracted from the voice with noise added thereto, and is converted into a code of a voice obtained by suppressing the noise in the voice with noise added thereto. Linear predictive coefficients are obtained from the code, and the voice signal is reproduced in a synthesis filter according to the linear predictive coefficients.

9 Claims, 3 Drawing Sheets

FIG. 3

| $b_x$ \ $a_y$ | 1 | 2 | 3 | 4 | ..... | 255 | 256 |
|---|---|---|---|---|---|---|---|
| 1 | 5 | 7 | 200 | 38 | | 133 | 133 |
| 2 | 57 | 129 | 256 | 222 | | 199 | 201 |
| 3 | 64 | 83 | 63 | 1 | | 40 | 69 |
| 4 | 4 | 200 | 82 | 95 | | 79 | 59 |
| ⋮ | | | | | | | |
| 255 | 195 | 253 | 18 | 77 | | 81 | 2 |
| 256 | 21 | 177 | 90 | 190 | | 100 | 33 |

NOISE SUPPRESSOR

BACKGROUND OF THE INVENTION

1. Field of the Invention

The present invention relates to a noise suppressor suitable for use for example in suppressing noise included in a voice.

2. Description of the Related Art

In a noise suppressor of a conventional type, it is practiced for example that the spectrum or a voice including noise is calculated and the spectrum of only the noise is also calculated and, then, the difference between the spectrum of the voice including noise and the spectrum of the noise is obtained to thereby achieve elimination (suppression) of the noise.

There is also realized a noise suppressor in which noise is spectrally analyzed to obtain an adaptive inverse filter which has a characteristic inverse to that of a noise generating filter and, then, voice including noise is passed through the adaptive inverse filter to thereby achieve elimination (suppression) of the noise.

In such conventional noise suppressors as described above, a noise and a voice including the noise are separately processed and therefore devices, for example microphones, for inputting the noise and the voice including the noise are required independently of each other. Namely, two microphones are required and, hence, there have been such problems that the circuits constituting the apparatus increase in number and the cost for manufacturing the apparatus becomes high.

SUMMARY OF THE INVENTION

The present invention has been made in view of the situation as described above. Accordingly, an object of the present invention is to provide a noise suppressor simple in structure, small in size, and low in cost.

In order to achieve the above mentioned object, a noise suppressor according to the present invention comprises a microphone 1 as input means for inputting a voice of interest and a voice of interest including noise, a linear predictive analyzer (LPC analyzer) 3 and a cepstrum calculator 4 as feature parameter extracting means for extracting feature parameters of the voice of interest and feature parameters of the voice of interest including noise, a vector-quantizer 5 as code generating means for vector-quantizing the feature parameters of the voice of interest and the feature parameters of the voice of interest including noise and generating a code of the voice of interest and a code of the voice of interest including noise, and a code converter 6 as code converting means for associating, in terms of probability, the code of the voice of interest and the code of the voice of interest including noise and converting the code of the voice of interest including noise to the code of the voice of interest.

The noise suppressor may further comprise a synthesis filter 10, a D/A converter 11, and a speaker 12 as voice generating means for generating the voice of interest from the feature parameters of the reproduced voice of interest.

In the above described noise suppressor, feature parameters of the voice of interest and the voice of interest including noise input through the microphone 1 are extracted, the extracted feature parameters of the voice of interest and feature parameters of the voice of interest including noise are vector-quantized, the code of the voice of interest and the code of the voice of interest including noise are produced, the code of the voice of interest and the code of the voice of interest including noise are associated with each other in terms of probability, and the code of the voice of interest including noise is converted to the code of the voice of interest. Accordingly, the noise input through the microphone 1 can be suppressed.

When feature parameters of the voice of interest is reproduced from the code of the voice of interest converted by the code converter 6 and the voice of interest is generated from the feature parameters of the reproduced voice of interest, the voice of interest whose noise is suppressed can be recognized.

BRIEF DESCRIPTION OF THE DRAWINGS

FIG. 3, a diagram showing structure of an embodiment of a code conversion table which is referred to in the code converter 6 in the embodiment of FIG. 1.

DESCRIPTION OF THE PREFERRED EMBODIMENTS

Figure 1:
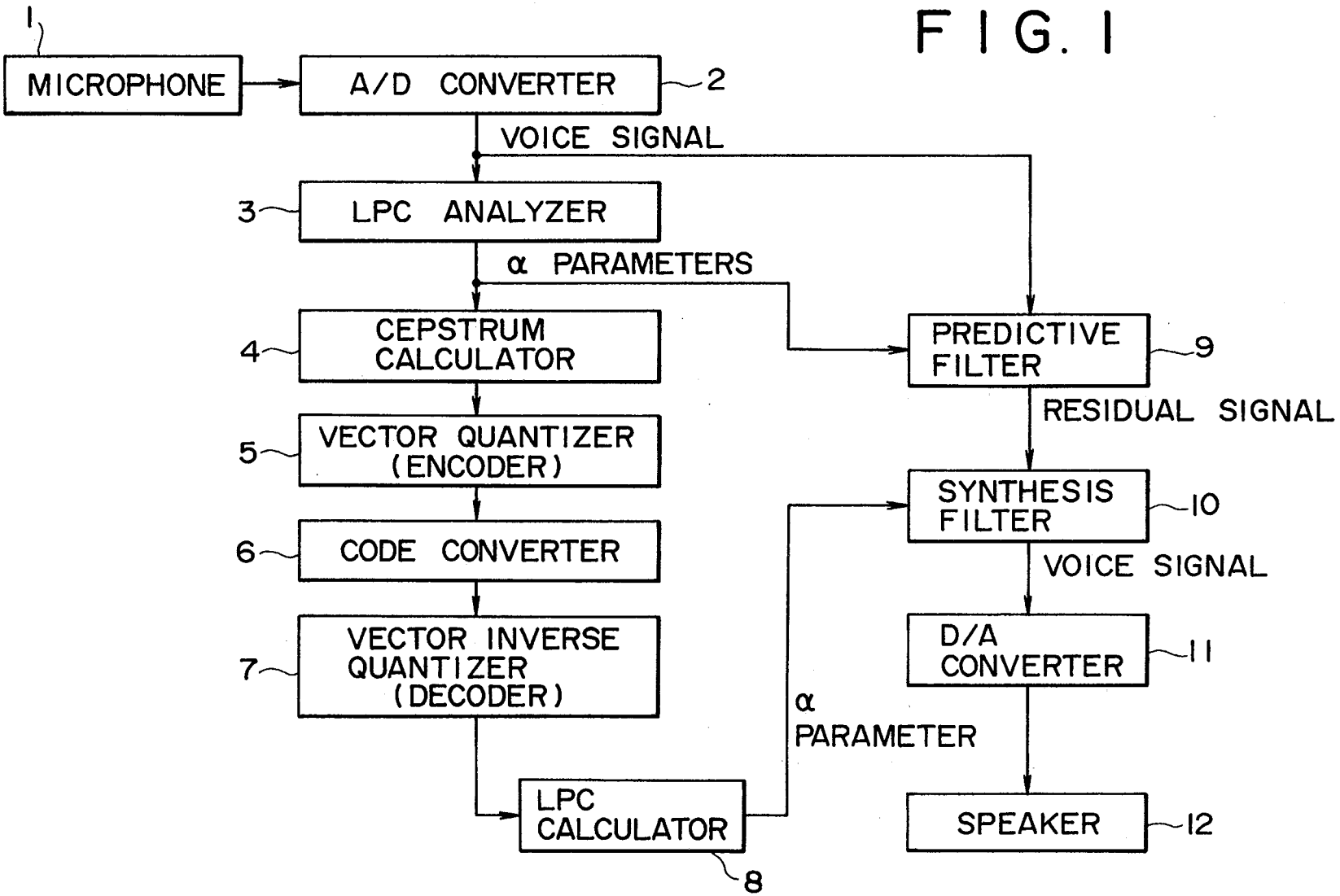
FIG. 1 is a block diagram showing structure of an embodiment of a noise suppressor according to the present invention.

FIG. 1 is a block diagram showing the structure of an embodiment of a noise suppressor according to the present invention. A microphone 1 converts an input voice to an electric signal (voice signal). An A/D converter 2 performs sampling (A/D conversion) on the voice signal output from the microphone 1 at a predetermined sampling period. A LPC analyzer (linear predictive analyzer) 3 performs linear prediction on the sampled voice signal (sampled value) output from the A/D converter 2 for each predetermined analysis interval unit to thereby calculate linear predictive coefficients (LPC) ($\alpha$ parameters).

First, it is assumed that a linear combination with a sampling value $x_t$ sampled at the current time t and p sampling values $x_{t-1}, x_{t-2}, \ldots, X_{t-p}$ sampled at past times adjoining the current time as expressed below holds:

$$x_t+\alpha_1 x_{t-1}+\alpha_2 x_{t-2}+\ldots+\alpha_p x_{t-p}=\epsilon_t \quad (1)$$

where $\{\epsilon_t\}(\ldots, \epsilon_{t-1}, \epsilon_t, \epsilon_{t+1}, \ldots)$ represent random variables, of which the average value is 0 and the variances $\sigma^2$ ($\sigma$ is a predetermined value) are not correlative with one another, and $\alpha_1, \alpha_2, \ldots, \alpha_p$ represent the linear predictive coefficients (LPC or $\alpha$ parameters) calculated by the above described LPC analyzer 3.

Further, if the predictive value (linear predictive value) of the sampled value $x_t$ of the current time t is represented by $x'_t$, the linear predictive value $x'_t$ can be expressed (can be linearly predicted) using p sampling values $x_{t-1}, x_{t-2}, \ldots, x_{t-p}$ sampled at past times as in the following expression (2)

$$x'_t=-(\alpha_1 X_{t-1}+\alpha_2 X_{t-2}+\ldots+\alpha_p x_{t-p}) \quad (2)$$

From expressions (1) and (2) is obtained $$x_t-x'_t=\epsilon_t \quad (3)$$

where $\epsilon_t$ can be said to be the error (linear prediction residual or residual) of the linear predictive value $x'_2$ with respect to the actual sampled value $x_t$.

The LPC analyzer 3 calculates the coefficients ($\alpha$ parameters) $\alpha_1, \alpha_2, \ldots, \alpha_p$ of the expression (1) such that the sum of squares Et of the error (residual) $\epsilon_t$ between the actual sampling value $x_t$ and the linear predictive value $x'_t$ may be minimized.

A cepstrum calculator 4 calculates cepstrum coefficients $c_1, c_2, \ldots, c_q$ (q is a predetermined order) from the $\alpha$ parameters calculated by the LPC analyzer 3. Here, the cepstrum of a signal is an inverse Fourier transform of the logarithm of the spectrum of the signal. It is known that the cepstrum coefficients of low degree indicate the feature of the spectral envelope line of the signal and the cepstrum coefficients of high degree indicate the feature of the fine structure of the spectrum of the signal. Further, it is known that the cepstrum coefficients $c_1, c_2, \ldots, c_q$ are obtained from the linear predictive coefficients $\alpha_1, \alpha_2, \ldots, \alpha_p$ according to the below mentioned recursive formulas.

$$c_1 = \alpha_1 \tag{4}$$

$$c_k = -\alpha_k - ((1 - 1/k)\alpha_1 c_{k-1} + (1 - 2/k)\alpha_2 c_{k-2} + \ldots + (1 - (k-1)/k)\alpha_{k-1} C_{k-(k-1)}) \quad \text{where } 1 < k < p \tag{5}$$

$$c_k = -((1 - 1/k)\alpha_1 c_{k-1} + (1 - 2/k)\alpha_2 c_{k-2} + \ldots + (1 - p/k)\alpha_p c_{k-p}) \quad \text{where } p < k \tag{6}$$

Accordingly, the cepstrum calculator 4 calculates the cepstrum coefficients $c_1, c_2, \ldots, c_q$ (q is a predetermined order) from the $\alpha$ parameters calculated by the LPC analyzer 3 according to the expressions (4) to (6).

Now, cepstrum coefficients $c_1, c_2, \ldots, c_q$ temporally (successively) output from the cepstrum calculator 4 are considered as vectors in a q-dimensional space. Also, for example 256 centroids, which are previously calculated from a set of cepstrum coefficients as a standard pattern according to a strain measure, are considered present in the q-dimensional space. A vector-quantizer (encoder) 5 outputs (vector-quantizes) codes (symbols) of the above vectors by assigning each vector to a centroid which is located at a minimum distance from the vector. Namely, the vector-quantizer 5 detects the centroids each of which is at a minimum distance from each of the cepstrum coefficients (vectors) $c_1, c_2, \ldots, c_q$ output from the cepstrum calculator 4 and, thereupon, outputs the codes corresponding to the detected centroids by referring to a table made up in advance (code book) showing correspondence between a centroid and a code assigned to the centroid.

In the present embodiment, a code book having for example 256 codes $a_i$ ($1 \leqq i \leqq 256$) obtained from a voice without noise, only voice, as a standard pattern (a temporal set of cepstrum coefficients of a voice without noise) and a code book having for example 256 codes $b_i$ ($1 \leqq i \leqq 256$) obtained from a voice with noise added thereto (a temporal set of cepstrum coefficients of a voice with noise added thereto) are made up in advance and each code book is stored in memory (not shown).

A code converter 6 converts codes obtained from the voice of interest including noise (voice with noise added thereto) and output from the vector-quantizer 5 into codes obtained from the voice of interest (voice without noise) by referring to a later described code conversion table stored in a memory, not shown, incorporated therein. A vector inverse quantizer (decoder) 7 decodes (inversely quantizes) the codes obtained from the voice without noise and output from the code converter 6 into centroids corresponding to the codes, i.e., cepstrum coefficients (cepstrum coefficients of a voice without noise) $c'_1, c'_2, \ldots, c'_q$, by referring to the above described code book having 256 codes $a_i$ ($1 \leqq i \leqq 256$) obtained from the voice without noise stored in memory. A LPC calculator 8 calculates linear predictive coefficients $\alpha'_1, \alpha'_2, \ldots, \alpha'_p$ of a voice without noise from the cepstrum coefficients (cepstrum coefficients of a voice without noise) $c'_1, c'_2, c'_q$ output from the vector inverse quantizer 7 according to the below mentioned recursive expressions.

$$\alpha_1' = c_1' \tag{7}$$

$$\alpha_k' = -c_k' - ((1 - 1/k)\alpha_1' c_{k-1}' + (1 - 2/k)\alpha_2' c_{k-2}' + \ldots + (1 - (k-1)/k)\alpha_{k-1}' c_{k-(k-1)}') \quad \text{where } 1 \leqq k \leqq p \tag{8}$$

A predictive filter 9 calculates a residual signal $\epsilon_t$ by substituting the linear predictive coefficients $\alpha_1, \alpha_2, \ldots, \alpha_p$ of the voice with noise added thereto output from the LPC analyzer 3 and the voice signal $x_t, x_{t-1}, x_{t-2}, \ldots, x_{t-p}$ used for calculating the linear predictive coefficients $\alpha_1, \alpha_2, \alpha_p$ into the expression (1).

A synthesis filter 10 reproduces a voice signal $x_t$ by substituting the linear predictive coefficients $\alpha'_1, \alpha'_2, \ldots, \alpha'_p$ of the voice without noise from the LPC calculator 8 and the residual signal $\epsilon_t$ output from the predictive filter 9 into the following expression (9) which is a modification of the expression (1) obtained by replacing the linear predictive coefficients in the expression (1) by the linear predictive coefficients of the voice without noise.

$$x_t = \epsilon_t - (\alpha'_1 x_{t-1} + \alpha'_2 x_{t-2} + \ldots + \alpha'_p x_{t-p}) \tag{9}$$

A D/A converter 11 gives a D/A conversion treatment to the voice signal (digital signal) output from the synthesis filter 10 to thereby output an analog voice signal. A speaker 12 outputs a voice corresponding to the voice signal output from the D/A converter 11.

Figure 2:
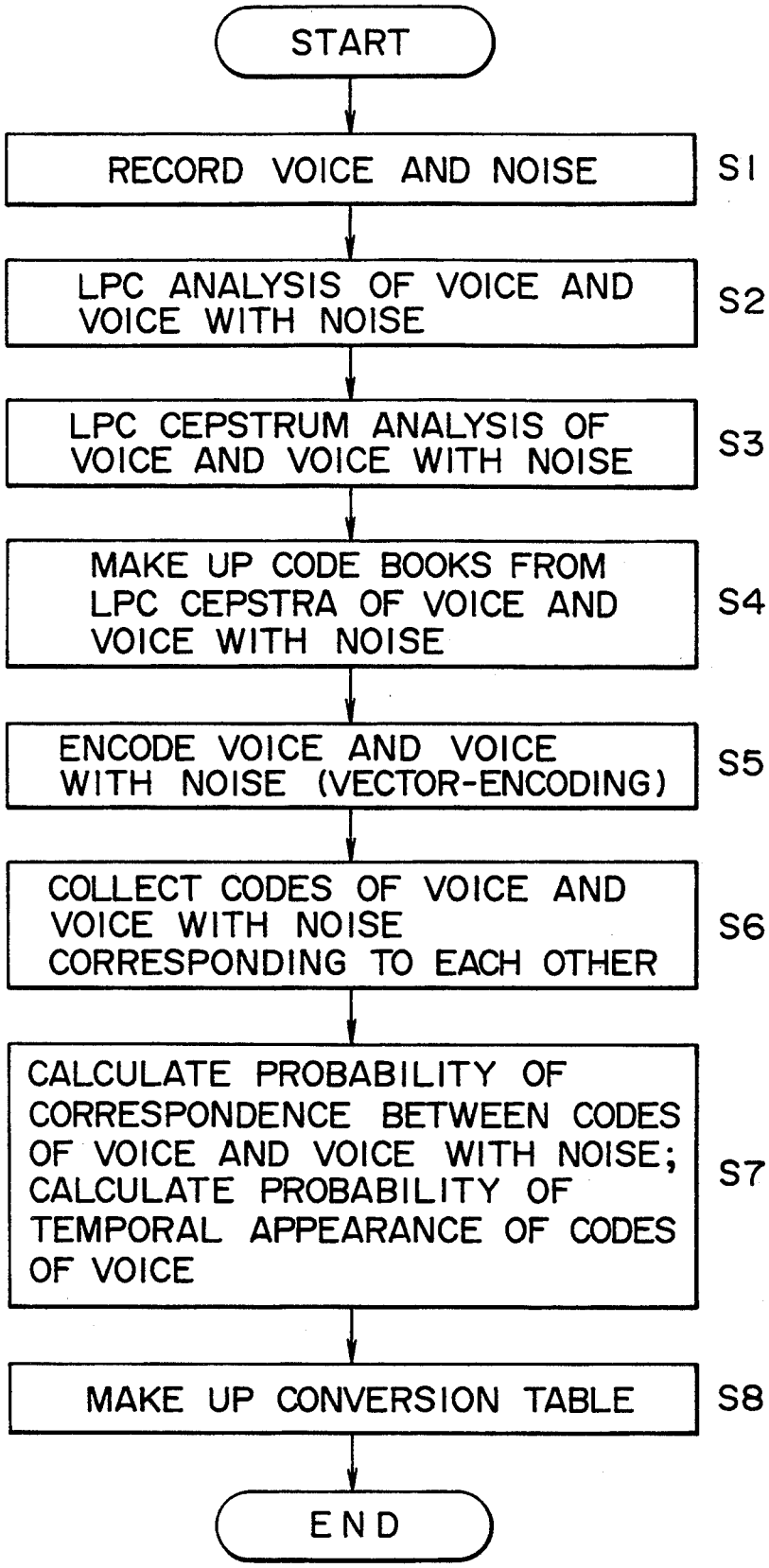
FIG. 2 is a flow chart explanatory of the procedure for making up a code conversion table which is referred to in a code converter 6 in the embodiment of FIG. 1.

Now, referring to a flow chart of FIG. 2, the method for making up the code conversion table used in the code converter 6 will be described. First, in step S1, only a voice, i.e., a voice without noise, and only a noise are recorded in a recording medium. Here, in order to form the code conversion table into a multi-template type, the voice without noise recorded in the step S1 was obtained by having various words (voices) spoken by unspecified speakers. Also, for the noise, various sounds (noises) such as engine sounds of motorcars and sounds of running electric trains were recorded.

In step S2, the voice without noise recorded in the recording medium in the step S1 and a voice with noise added thereto, which is obtained by adding the noise to the voice without noise, are subjected to linear predictive analysis successively for each predetermined unit of analysis interval to thereby obtain linear predictive coefficients for example of order p for each of them. In the following step S3, cepstrum coefficients for example of order g for both the linear predictive coefficients of the voice without noise and the linear predictive coefficients of the voice with noise added thereto are obtained from the same according to the expressions (4) to (6) (the cepstrum is specially called the LPC cepstrum because it is that obtained from linear predictive coefficients (LPC)).

In step S4, for example 256 centroids in a q-dimensional space are calculated from the cepstrum coefficients of the voice without noise and the cepstrum coefficients of the voice with noise added thereto as q-dimensional vectors on the basis of strain measures, and thereby the code books as tables of the calculated 256 centroids and the 256 codes corresponding to the centroids are obtained. In step S5, the code books (the code book for the voice without noise and the code book for the voice with noise added thereto) obtained from the cepstrum coefficients of the voice without noise and the cepstrum coefficients of the voice with noise added thereto in the step S4 are referred to and, thereby, the cepstrum coefficients of the voice without noise and the cepstrum coefficients of the voice with noise added thereto calculated in the step S3 are vector-quantized codes $a_i$ ($1 \leqq i \leqq 256$) of the voice without noise and codes $b_i$ ($1 \leqq i \leqq 256$) of the voice with noise added thereto are successively obtained for each predetermined unit of analysis interval.

In step S6, a collection as to correspondence between the codes $a_i$ ($1 \leqq i \leqq 256$) of the voice without noise and the codes $b_i$ ($1 \leqq i \leqq 256$) of the voice with noise added thereto, i.e., a collection is performed as to to which code of the voice without noise the code of the voice with noise added thereto, which is obtained by adding noise to the voice without noise, corresponds in the same analysis interval. In the following step S7, the probability as to correspondence between the codes $a_i$ ($1 \leqq i \leqq 256$) of the voice without noise and the codes $b_i$ ($1 \leqq i \leqq 256$) of the voice with noise added thereto is calculated from the results of the collection as to correspondence performed in the step S6. More specifically, the probability $P(b_i, a_j) = p_{ij}$ of correspondence, in the same analysis interval, between the code $b_i$ with noise added thereto and the code $a_j$ ($1 \leqq j \leqq 256$) obtained by vector-quantizing the voice without noise, i.e., the voice with noise added thereto in its state before it was added with the noise. Further, in the step S7, the probability $Q(a_i, a_j) = q_{ij}$, in which the code $a_j$ is obtained when the voice without noise is vector-quantized in the step S5 in the current analysis interval, in the case where the code obtained by vector-quantizing the voice without noise in the step S5 in the preceding analysis interval was $a_i$, is calculated.

In step S8, when the code currently obtained in the step S5 by vector-quantizing the voice with noise added thereto is $b_x$ ($1 \leqq \times \leqq 256$) and the code of the voice without noise in the preceding analysis interval was $a_y$ ($1 \leqq y \leqq 256$), the code $a_j$ maximizing the probability $P(b_x, a_j) \times Q(a_y, a_j) = p_{xj} \times q_{yj}$ is obtained for all combinations of $b_x$ ($1 \leqq \times \leqq 256$) and $a_y$ ($1 \leqq y \leqq 256$), and, thereby, a code conversion table, in which the code $b_x$ obtained by vector-quantizing the voice with noise added thereto in the step S5 is associated with the code $a_j$ of the voice without noise in terms of probability, can be made up. Thus, the procedure is finished.

FIG. 3 shows an example of a code conversion table made up through the steps S1 to S8 of the above described procedure. The code conversion table is stored in a memory incorporated in the code converter 6, and the code converter 6 outputs the code in a box at the intersection of the row of the code $b_x$ of the voice with noise added thereto output from the vector-quantizer 5 and the column of the code $a_y$ of the voice without noise output from the code converter 6 in the preceding interval as the code of the voice (voice without noise) obtained by suppressing the noise added to (included in) the voice with noise added thereto.

Now, operation of the present embodiment will be described. A voice with noise added thereto produced by having a voice spoken by a user added with a noise in the circumference where the apparatus is used is converted into a voice signal (voice signal with noise added thereto) as an electric signal in the microphone 1 and supplied to the A/D converter 2. In the A/D converter 2, the voice signal with noise added thereto is subject to sampling at a predetermined sampling period and the sampled voice signal with noise added thereto is supplied to the LPC analyzer 3 and the predictive filter 9.

In the LPC analyzer 3, the sampled voice signal with noise added thereto is subjected to LPC analysis for each predetermined unit of analysis interval in succession ($p+1$ samples, i.e., $x_t, x_{t-1}, x_{t-2}, \ldots, x_{t-p}$), namely, linear predictive coefficients $\alpha_1, \alpha_2, \ldots, \alpha_p$ are calculated such that the sum of squares of the predictive residual $\epsilon t$ in the expression (1) is minimized, and the coefficients are supplied to the cepstrum calculator 4 and the predictive filter 9. In the cepstrum calculator 4, cepstrum coefficients for example of order q, $c_1, c_2, \ldots, c_q$, are calculated from the linear predictive coefficients $\alpha_1, \alpha_2, \ldots, \alpha_p$ according to the recursive expressions (4) to (6).

In the vector-quantizer 5, the code book, made up from the voice with noise added thereto (the voice obtained by adding noise to the voice without noise) as a standard pattern, stored in the memory incorporated therein is referred to and, thereby, the cepstrum coefficients of order q, $c_1, c_2, \ldots, c_q$ (q-dimensional vectors), output from the cepstrum calculator 4 are vector-quantized and, thus, the code $b_x$ of the voice with noise added thereto is output.

In the code converter 6, the code conversion table (FIG. 3) stored in the memory incorporated therein is referred to and the code $a_j$ of the voice without noise maximizing the probability $P(b_x, a_j) \times Q(a_y, a_j)$ is found from the code $b_x$ of the voice with noise added thereto in the current analysis interval output from the vector-quantizer 5 and the code $a_y$ of the voice without noise which was code converted by the code converter 6 in the preceding analysis interval and output therefrom.

More specifically, when, for example, the code $b_x$ of the voice with noise added thereto output from the vector-quantizer 5 is "4" and the code $a_y$ of the voice without noise output from the code converter 6 in the preceding interval was "1" the code conversion table of FIG. 3 is referred to in the code converter 6 and the code "4" in the box at the intersection of the row of $b_x = 4$ and the column $a_y =$ "1" is output as the code (the code of the voice without noise) $a_j$. Then, if the code $b_x$ of the voice with noise added thereto output from the vector-quantizer 5 is "2" in the following interval, the code conversion table of FIG. 3 is referred to in the code converter 6. In this case, $b_x = 2$ and $a_y$, the code of the voice without noise (the code of the voice obtained by suppressing the noise in the voice with noise added thereto), equals 4, and therefore, the code "222" in the corresponding box is output as the code of the voice (the code of the voice without noise) $a_j$, obtained by suppressing the noise in the voice with noise added thereto (the code of the voice with noise added thereto)

output from the vector-quantizer 5 in the current interval.

In the vector inverse quantizer 7, the code book made up from the voice without noise as a standard pattern stored in the memory incorporated therein is referred to and the vector $a_j$ of the voice without noise output from the code converter 6 is inverse vector-quantized to be converted into the cepstrum coefficients $c'_1, c'_2, \ldots, c'_q$ of order g (vectors of order q) and delivered to the LPC calculator 8. In the LPC calculator 8, the linear predictive coefficients $\alpha'1, \alpha'_2, \ldots, \alpha'_p$ of the voice without noise are calculated from the cepstrum coefficients $c'_1, c'_2, \ldots, c'_q$ of the voice without noise output from the vector inverse quantizer 7 according to recursive expressions (7) and (8) and they are supplied to the synthesis filter 10.

On the other hand, in the predictive filter 9, the predictive residual $\epsilon_t$ is calculated from the sampled values $x_t, x_{t-1}, x_{t-2}, \ldots, x_{t-p}$ of the voice with noise added thereto supplied from the A/D converter 2 and the linear predictive coefficients $\alpha_1, \alpha_2, \ldots, \alpha_p$ obtained from the voice with noise added thereto supplied from the LPC analyzer 3, according to the expression (1), and the residual is supplied to the synthesis filter 10. In the synthesis filter 10, the voice signal (sampled values) (digital signal) $x_t$ is reproduced (calculated), according to the expression (9), from the linear predictive coefficients $\alpha'_1, \alpha'_2, \ldots, \alpha'_p$ of the voice without noise output from the LPC calculator 8 and the residual signal $\epsilon_t$ obtained from the voice with noise added thereto output from the predictive filter 9, and the voice signal is supplied to the D/A converter 11.

In the D/A converter 11, the digital voice signal output from the synthesis filter 10 is D/A converted and supplied to the speaker 12. In the speaker 12, the voice signal (electric signal) is converted to voice to be output.

As described above, a code conversion table in which the code $b_x$ of the voice with noise added thereto is associated with the code $a_j$ of the voice without noise in terms of probability is made up. According to the code conversion table, the code obtained by vector-quantizing the cepstrum coefficients as feature parameters of the voice extracted from the voice with noise added thereto is converted into a code of the voice obtained by suppressing the noise in the voice with noise added thereto (a code of the voice without noise). Since the input voice with noise added thereto is reproduced according to the linear predictive coefficients obtained from the code, it is made possible to reproduce a voice (voice without noise) provided by suppressing the noise included in the voice with noise added thereto.

While, in the above embodiment, cepstrum coefficients were used as the feature parameters of a voice to be vector-quantized in the vector-quantizer 5, other feature parameters such as linear predictive coefficients can be used instead of the cepstrum coefficients.

According to an aspect of the noise suppressor of the present invention, since feature parameters of a voice of interest and a voice of interest including noise input from an input means are extracted. The feature parameters of the voice of interest and the feature parameters of the voice of interest including noise are vector-quantized and, thereby, codes of the voice of interest and the voice including noise of interest are produced. The code of the voice of interest and the code of the voice of interest including noise are associated with each other in terms of probability and, thereby, the code of the voice of interest including noise is converted to the code of the voice of interest. Accordingly, the noise in the voice of interest including noise can be suppressed, and an apparatus achieving such noise suppression simple in structure and low in cost can be provided.

According to another aspect of the noise suppressor of the present invention, feature parameters of a voice of interest are reproduced from the code of the voice of interest converted by a code conversion means and the voice of interest is generated from the reproduced feature parameters of the voice of interest, the voice of interest with the noise suppressed can be obtained.

What is claimed is:

1. A noise suppressor comprising:

input means for inputting a first electrical voice signal corresponding to a first voice of interest, said first electrical voice signal substantially lacking a noise component, and a second electrical voice signal corresponding to a second voice of interest, said second electrical signal having a noise component;

feature parameter extracting means for extracting feature parameters including at least linear predictive coefficients (LPCs) of the first electrical voice signal and feature parameters including at least LPCs of the second electrical voice signal input through said input means;

code generating means for vector-quantizing the feature parameters of the first electrical voice signal and the feature parameters of the second electrical voice signal extracted by said feature parameter extracting means, and for generating a first code of the first electrical voice and a second code of the second electrical voice signal, said first code and said second code being based respectively on vector-quantized feature parameters of the electrical voice signal and vector-quantized feature parameters of the second electrical voice signal; and code converting means for associating, in terms of probability, the first code and the second code generated by said code generating means, and for converting the second code to the first code.

2. A noise suppressor according to claim 1, further comprising:

feature parameter reproducing means for reproducing feature parameters of the first electrical voice signal of from the first code converted by said code converting means; and voice generating means for generating the first electrical voice signal from the feature parameters of the first voice signal reproduced by said feature parameter reproducing means.

3. A noise suppressor comprising:

a microphone for inputting a first electrical voice signal corresponding to a first voice of interest, said first electrical voice signal substantially lacking a noise component, and a second electrical voice signal corresponding to a second voice of interest, said second electrical signal having a noise component;

an A/D converter for A/D converting information input through said microphone;

a linear predictive analyzer and a cepstrum detector for extracting feature parameters including at least linear predictive coefficients (LPCs) of the first electrical voice signal and feature parameters including at least LPCs of the second electrical voice signal output from said A/D converter;

a vector-quantizer for vector-quantizing the feature parameters of the first electrical voice signal and the feature parameters of the second electrical voice signal extracted by said analyzer and said cepstrum detector and for generating a first code of the first electrical voice signal and a second code of the second electrical voice signal of interest, said first code and said second code being based respectively on vector-quantized feature parameters of the first electrical voice signal and vector-quantized feature parameters of the second electrical voice signal; and a code converter for associating, in terms of probability, the first code and the second code generated by said vector-quantizer, and converting the second code to the first code.

4. A noise suppressor according to claim 3, further comprising:

a vector inverse quantizer and a linear predictive coefficient calculator for reproducing feature parameters of the first electrical voice signal from the first code converted by said code converter; and voice generating means for generating the first electrical voice signal from the feature parameters of the first electrical voice signal reproduced by said vector inverse quantizer and linear predictive coefficient calculator.

5. A noise suppressor according to claim 4, wherein said voice generating means includes a predictive filter for generating a residual signal from the second electrical voice signal output from said A/D converter, and wherein said voice generating means further includes synthesis filter means for generating the first electrical voice signal on the basis of said residual signal.

6. A noise suppressor according to claim 5, wherein said voice generating means comprises:

a synthesis filter for generating an electrical voice signal on the basis of the residual signal from said predictive filter and the linear predictive coefficients from said linear predictive coefficient calculator;

a D/A converter for D/A converting the electrical voice signal from said predictive filter; and a speaker for outputting the information output from said D/A converter.

7. A noise suppressor apparatus for reducing noise accompanying a spoken voice comprising:

input means for providing an analog electrical signal corresponding to the spoken voice, said electrical signal including a component corresponding to said noise;

an analog to digital converter for converting said analog electrical signal to a corresponding first digital signal;

a linear predictive analyzer for calculating first linear predictive coefficients (LPCs) associated with said digital signal and supplying said first LPCs to a predictive filter and to a cepstrum calculator which calculates cepstrum coefficients based on said first LPCs according to recursive relationships, said predictive filter calculating a residual signal based on said first digital signal and said first LPCs;

code generating means for vector-quantizing said cepstrum coefficients according to first and second code tables stored in memory to provide first codes associated with said cepstrum coefficients, said first code table being formulated from a voice digital signal pattern which substantially lacks noise and said second code table being formulated from a digital signal pattern which is comprised of noise components;

code converting means for providing second codes based on said first codes according to a code conversion table stored in memory;

decoder means for inverse vector-quantizing cepstrum coefficients vector quantized with said code generating means;

a linear predictive calculator for calculating second LPCs according to cepstrum coefficients inverse vector-quantized by said decoder means;

synthesis filter means for providing a second digital signal corresponding to said spoken voice, said synthesis filter means calculating said second digital signal from said second LPCs and from said residual signal obtained from said predictive filter.

8. The apparatus according to claim 7 wherein each of said cepstrum coefficients has a corresponding vector and said code generating means assigns each vector output from said centrum calculator to a centroid located a minimum distance from each vector, wherein said minimum distance is determined from said first and second code books stored in memory.

9. The apparatus according to claim, 7 wherein said code conversion table is stored in memory by:

recording a first sample digital signal representing spoken words;

recording a second sample digital signal representing said first sample digital signal with background nonspoken sounds added thereto;

analyzing said first sample digital signal and said second sample digital signal by linear predictive analysis to obtain first sample LPCs corresponding to said first sample digital signal and second sample LPCs corresponding to said second sample digital signal;

providing first and second cepstrum coefficients corresponding respectively with said first and second sample digital signals;

calculating respectively first and second sample centroids from said first and second cepstrum coefficients;

vector-quantizing said first and second sample centroids to obtain first sample codes corresponding to said first sample digital signal and second sample codes corresponding to said second sample digital signal;

associating first and second sample codes which correspond over a given temporal interval;

calculating a probability of correspondence for each associated first and second sample codes; and storing the calculated probabilities of correspondence in a memory.

* * * * *